US005560574A

United States Patent [19]

Vanderploeg

[11] Patent Number: 5,560,574

[45] Date of Patent: Oct. 1, 1996

[54] BRICK WALL HANGING HOOKS

[76] Inventor: George Vanderploeg, 111 Keystone Court, Thunder Bay, Ontario, Canada, P7C 2E6

[21] Appl. No.: 328,460

[22] Filed: Oct. 25, 1994

[51] Int. Cl.[6] ..... A47F 7/00

[52] U.S. Cl. ..... 248/222.11

[58] Field of Search ..... 247/225.1, 303, 247/218.2, 218.1, 217.3, 221.4, 220.2; 24/600.9, 67.11, 67.9, 369, 370, 598.1

[56] References Cited

U.S. PATENT DOCUMENTS

| | | | |
|---|---|---|---|
| 274,672 | 3/1883 | Thomason . | |
| 1,439,302 | 12/1922 | Erickson . | |
| 1,933,218 | 10/1993 | Miller | 248/303 X |
| 2,471,584 | 5/1949 | Richards . | |
| 2,850,820 | 9/1958 | Lersch | 248/303 X |
| 3,288,414 | 11/1966 | Fortunato | 248/221.4 |
| 3,297,290 | 1/1967 | Patterson | 248/221.4 |
| 4,145,840 | 3/1979 | Davidson | 248/221.4 |
| 4,337,915 | 7/1982 | Cali . | |
| 4,375,880 | 3/1983 | Sinclair | 248/225.1 |
| 5,022,623 | 6/1991 | Laarman . | |

FOREIGN PATENT DOCUMENTS

| | | | |
|---|---|---|---|
| 122089 | 6/1948 | Sweden | 248/221.4 |

*Primary Examiner*—Alvin C. Chin-Shue
*Assistant Examiner*—Sarah L. Purol
*Attorney, Agent, or Firm*—Murray E. Thrift; Adrian D. Battison

[57] ABSTRACT

A hook made of a resilient material for use with brick walls having recessed mortar joints. The hook comprises a hook member and two arms. The hook member is placed in a vertical mortar joint on the brick wall and each arm member is placed in a horizontal mortar joint on the brick wall. The hook is held firmly in place by the arms in contact with the row of bricks lying above and below them.

20 Claims, 1 Drawing Sheet

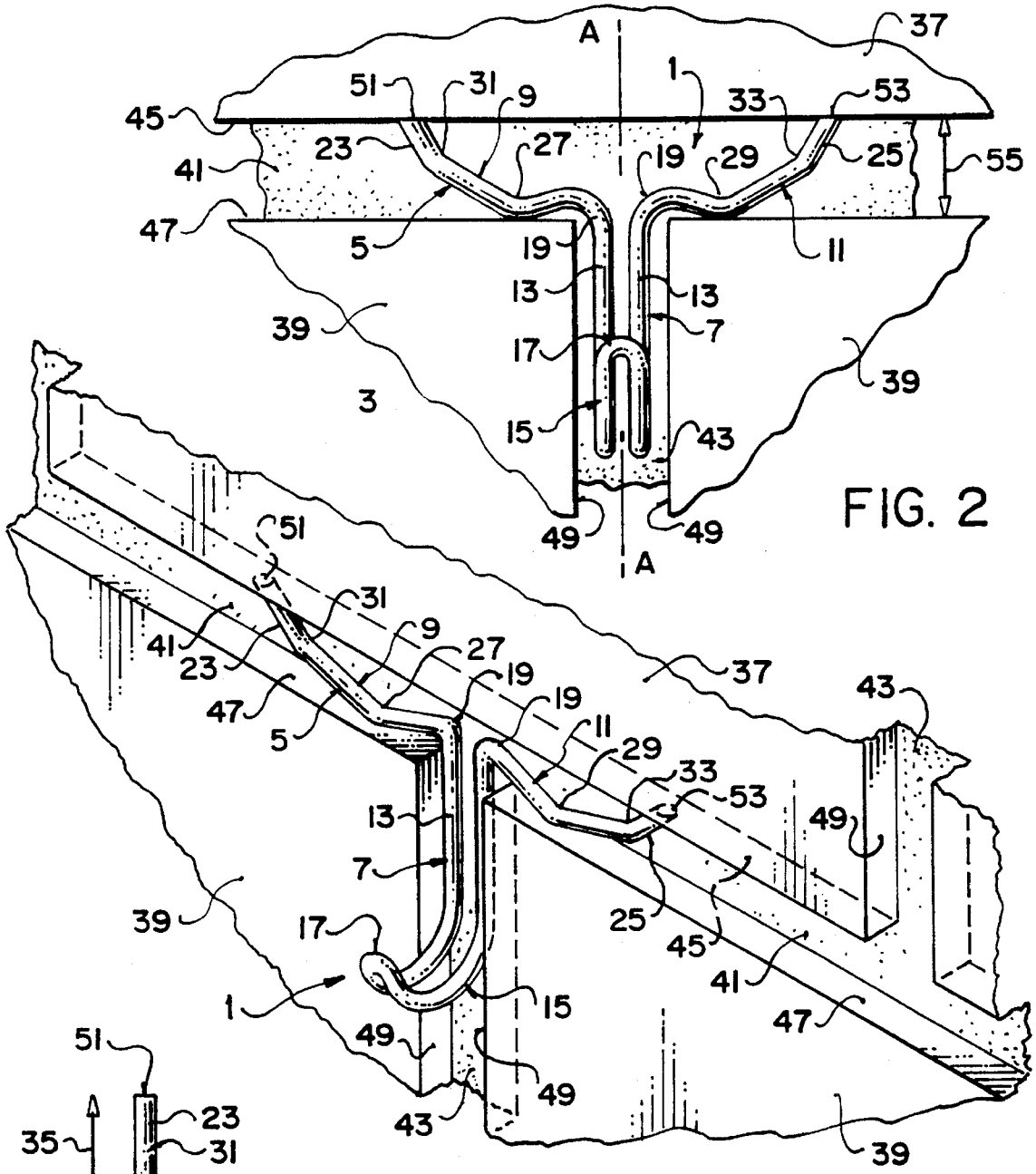
FIG. 2
FIG. 1
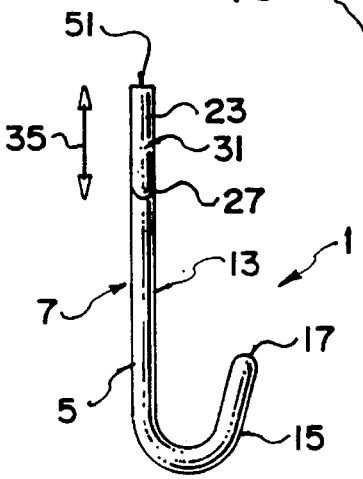
FIG. 3

BRICK WALL HANGING HOOKS

FIELD OF THE INVENTION

The present invention relates to a device for supporting objects hanging from walls and, more particularly, a hanging device for brick walls.

BACKGROUND OF THE INVENTION

Often it is desirable to cover and decorate walls with paintings, pictures, and various ornamental and decorative objects, or to hang items of use on walls for storage. This is usually done by drilling or otherwise making a hole in the wall and securing a holding device in the hole to hang the item on. This method works well for plaster walls where a hole can be patched easily if the item and holding device is later moved to another location or removed altogether.

If the wall is made of brick it is more difficult to fix a holding device to the wall. Brick being a brittle material can chip, crack, or portions can break away when drilling or installing the holding device. It is also difficult to repair any damage or holes made in the wall in an aesthetically pleasing way if the item and holding device is later moved.

Several attempts have been made to provide a solution to this problem. Laarman U.S. Pat. No. 5,022,623, issued Jun. 11, 1991, discloses a hanging device for brick walls that is held in place in a mortar groove in the wall using two machine screws. This device requires the use of tools to install. Its manufacture requires the drilling and threading of a number of holes in its base plate to allow it to be used with different sized mortar joints. This increases the cost of manufacturing the device and limits the size mortar grooves it can be used in.

Call, U.S. Pat. No. 4,337,915, issued Jul. 5, 1982, discloses a brick clip-on hanger which is placed over the front surface of a brick and held in place on the top by a flange with a serrated edge projecting into the top surface on the brick and by a lower spring part engaging the bottom surface of the brick to draw the teeth downward into the brick's upper surface. This requires a flat brick face to work properly, and is highly visible on the front face of the brick when installed.

Richards, U.S. Pat. No. 23,471,584, issued May 31, 1949 discloses a brick clip for fixing pipe, flashing or the like to a brick wall. The clip is placed in a mortar groove and has teeth projecting upwards into the under side of an upper brick. Two hooks project upwardly into the groove and a flange extends downwards over the face of the brick. The hooks are used for wiring a pipe to the clip. The flange may also be used for frictionally engaging cap flashing on the brick. This clip has limited holding power, because it is held in place by the teeth engaging only brick on the upper side of the mortar joint. It is not appropriate for hanging pictures and the like in that there is no appropriate means to engage the picture wire. The clip is not adaptable to different mortar groove widths and depths. As with Cali, the clip is visible on the front face of the brick when installed.

Other devices that mount on the front face of a brick are disclosed in Thomason, U.S. Pat. No. 274,672, issued Mar. 27, 1883 and Erickson, U.S. Pat. No. 1,439,302, issued Dec. 19, 1922.

The present invention is concerned with an improved device for hanging objects from brick walls.

SUMMARY OF THE INVENTION

According to one aspect of the present invention there is provided a hook for hanging an object on a brick wall having at least two courses of brick with a spacing therebetween, said hook comprising hanging means for engaging an object to be supported on the wall, two arms projecting outwardly from the hanging means in opposite lateral directions from one another, each arm having upper brick engagement means and lower brick engagement means spaced apart along the arm, and resiliently deformable means for biasing the arms to positions with the upper brick engagement means spaced from the lower brick engagement means a vertical distance greater than said spacing between said courses of brick.

Preferably, the lower brick engagement means lie laterally between the hanging means and the upper brick engagement means. This allows the arms to work as levers in the mortar groove, so that a downwards force on the hanging means will force both lower and upper brick engagement means more firmly against the brick.

The upper brick engagement means may be upwardly projecting parts of the respective arms, and the lower brick engagement means may be downwardly projecting parts of the respective arms.

Preferably, the hook is made of a single elongate piece of resilient wire. Each arm may include an obtuse angle bend between the respective upper and lower brick engagement means. The wire may be bent to alter the angle of the bend, allowing the hanger to be used with mortar joints of various thicknesses.

The hanging means is preferably a hook with a shank projecting downwards from the arms and generally coplanar with the arms, and a hooked end at the bottom of the shank member, the hooked end projects outwards from the plane of the shank and the arms.

According to another aspect of the invention there is provided a hook mounted on a brick wall for hanging an object on the brick wall, wherein the brick wall comprises upper and a lower courses of bricks spaced apart by a recessed, substantially horizontal mortar joint; and the hook comprises hanging means for engaging the object, two arms projecting outwardly from the hanging means in opposite directions along the mortar joint, each arm having upper brick engagement means and lower brick engagement means spaced apart along the mortar joint, and resiliently deformable means biasing the upper brick engagement means into engagement with a lower surface of the upper course of bricks and biasing the lower brick engagement means into engagement with an upper surface of the lower course of bricks.

The hook will attach to a wall of bricks with either a smooth or rough surface and will allow a picture or other item to be hung from the wall without the need to drill holes or otherwise damage the wall. The device is also inexpensive to manufacture and can be installed and removed without the use of tools.

BRIEF DESCRIPTION OF THE DRAWINGS

One embodiment of the invention will now be described in conjunction with the accompanying drawings in which:

FIG. 1 is an isometric view of the brick wall hanging hook in use.

FIG. 2 is a front view of the brick wall hanging hook.

FIG. 3 is a side view of the brick wall hanging hook.

DETAILED DESCRIPTION

Referring to the accompanying drawings, there is illustrated a hook 1 for hanging objects on a brick wall 3 is shown made of a single piece 5 of resilient wire material formed into a shape comprising a hook member 7, and two arms 9 and 11.

The hook member 7 has a shank 13 with a hooked bottom end 15. The shank and its hooked end are twinned lengths of the wire, formed into a bight 17 at the bottom end. At the top end 19 of the hook member 7, the two wire lengths join the respective arms 9 and 11. The shank 13 lies generally coplanar with the two arms. The hooked end 15 projects outwardly from the plane of the shank 13 and arms 9 and 11 so that it will project out from the surface of a brick wall when the hook is in use.

The arms 9 and 11 extend outwards generally horizontally to upturned sections 23 and 25 respectively at the ends of the arms 9 and 11. The arms project outwardly from the hook member 7 in opposite lateral directions so that the hook 1 is symmetrical about a vertical line A—A running centrally through it. The arms 9 and 11 have respective V-shaped portions 27 and 29 which lie between the hook member 7 and the ends of the arms. Each V-shaped portion 27 and 29 projects downwards from the arm. The arms 9 and 11 include respective obtuse angle bends 31 and 33 between the respective V-shaped portions 27 and 29 and the upturned arm sections 23 and 25. The vertical distance 35 from the bottom of the V-shaped portions and the ends of the arms is greater than the spacing between the bricks into which the hook is to be inserted.

The hook 1 is used with a brick wall 3 consisting of at least two courses 37 and 39 of bricks. The bricks of the illustrated wall 3 are laid in the usual way, with the centre of each brick aligned with the vertical mortar joints between the ends of bricks in the adjacent courses. The bricks are joined by the usual horizontal and vertical mortar joints 41 and 43 respectively. The horizontal mortar joint 41 leaves a surface 45 exposed on the bottom of the bricks above the joint, and a surface 47 on the top of bricks below the joint. The vertical mortar joint 43 leaves exposed surfaces 49 at the ends of the bricks.

The hook 1 is installed by placing the ends of the arms 51 and 53 in contact with the bottom surface 45 of an upper brick with the shank 7 of the hook member projecting downwards over a vertical mortar joint 43. A force is applied to the hook member 7 by pushing upwards on it thereby deforming the arms 9 and 11 elastically, bending them upwards. This positions the V-shaped portions of the arms 27 and 29 clear of the surface 47 of a lower brick. The hook member 7 is then pushed in towards the wall such that it seats within the vertical mortar joint 43. Moving the hook member into the vertical joint brings the V-shaped portion of each arm 27 and 29 into a position above the upper surface 47 of the lower row of bricks. The V-shaped portions are brought into contact with the upper surface of the lower bricks by removing the upward force applied to the hook member. Since the relaxed vertical distance between the ends 51 and 53 of the arms 9 and 11 and the bottoms of the V-shaped portions 27 and 29 is greater than the space 55 between the courses of the bricks 37 and 39 the arms remain deformed so as to fit therebetween resulting in a spring force biasing the V-shaped portions downwards and the ends of the arms upwards thereby holding the hook firmly between the two rows of bricks.

Removal of the hook is done by applying an upwards force to the hook member 7 thereby bending the arms 9 and 11 upwards, releasing the V-shaped portions 27 and 29 allowing the hook to be removed by pulling it outwards from the wall.

Adjustment of the brick wall hanging hook to fit different widths of mortar joint may be done if necessary by bending the arms 9 and 11 at the obtuse angle bends 31 and 33 up or down such that the vertical distance between the bottoms of the V-shaped portions 27 and 29 and the ends 51 and 53 of the arms is slightly larger than the thickness of the mortar joint.

While one embodiment of the invention has been described in the foregoing, other embodiments are possible without departing from the invention. For example, the illustrated embodiment is made of wire, but other suitable materials may be used. Likewise, the device may be used on walls other than brick walls provided they have grooved surfaces similar to that of a brick wall.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A hook for hanging an object on a brick wall having at least two courses of brick with a spacing therebetween, said hook comprising: hanging means for engaging an object to be supported on the wall, two arms projecting outwardly from the hanging means in opposite lateral directions from one another, each arm having upper brick engagement means and lower brick engagement means spaced apart along the arm, and resiliently deformable means for biasing the arms to positions with the upper brick engagement means spaced from the lower brick engagement means a vertical distance greater than said spacing between said courses of brick, and wherein each of the arms extend outwardly and upwardly from the hanging means.

2. A hook in accordance with claim 1 wherein the lower brick engagement means lie laterally between the hanging means and the respective upper brick engagement means.

3. A hook in accordance with claim 1 wherein each upper brick engagement means comprises an upwardly projecting part of the respective arm, and wherein each lower brick engagement means comprises a downwardly projecting part of the respective arm.

4. A hook in accordance with claim 1 wherein the hook is made of a resilient material.

5. A hook in accordance with claim 4 wherein both the arms and the holding means are all formed of a single elongate piece of material.

6. A hook in accordance with claim 5 wherein each arm is a wire.

7. A hook in accordance with claim 6 wherein each arm includes an obtuse angle bend between the respective upper and lower brick engagement means.

8. A hook in accordance with claim 7 wherein the lower brick engagement means comprise a downwardly oriented generally V-shaped portion of the arm.

9. A hook for hanging an object on a brick wall having at least two courses of brick with a spacing therebetween, said hook comprising: hanging means for engaging an object to be supported on the wall, two arms projecting outwardly from the hanging means in opposite lateral directions from one another, each arm having upper brick engagement means and lower brick engagement means spaced apart along the arm, and resiliently deformable means for biasing the arms to positions with the upper brick engagement means spaced from the lower brick engagement means a vertical distance greater than said spacing between said courses of brick, and wherein the hanging means includes a hook member having a shank member projecting downwards from the arms and generally coplanar with the arms, and a hook portion located at a bottom end of the shank member, the hook portion being oriented generally outwards from the plane of the shank member and the arms.

10. A hook in accordance with claim 9 wherein each of the arms extend outwardly and upwardly from the hook means.

11. A hook in accordance with claim 9 wherein the lower brick engagement means lie laterally between the hanging means and the respective upper brick engagement means.

12. A hook in accordance with claim 9 wherein each upper brick engagement means comprises an upwardly projecting part of the respective arm, and wherein each lower brick engagement means comprise a downwardly projecting part of the respective arm.

13. A hook in accordance with claim 9 wherein both the arms and the holding means are all formed of a single elongate piece of material.

14. A hook mounted on a brick wall for hanging an object on the brick wall, wherein the brick wall comprises upper and a lower courses of bricks spaced apart by a recessed, substantially horizontal mortar joint; and the hook comprises: hanging means for engaging the object, two arms projecting outwardly from the hanging means in opposite directions along the mortar joint, each arm having upper brick engagement means and lower brick engagement means spaced apart along the mortar joint, and resiliently deformable means biasing the upper brick engagement means into engagement with a lower surface of the upper course of bricks and biasing the lower brick engagement means into engagement with an upper surface of the lower course of bricks, and wherein the hanging means comprise a hook member, and wherein the wall comprises a recessed, substantially vertical mortar joint extending downwardly for the substantially horizontal recessed mortar joint and the hook member comprises at least one generally vertical shank member extending along the vertical mortar joint, and a hook portion spaced below the arms and projecting outwards from the vertical mortar joint.

15. A hook in accordance with claim 14 wherein the lower brick engagement means lie between the hanging means and the respective upper brick engagement means in a direction along the mortar joint.

16. A hook in accordance with claim 14 wherein each upper brick engagement means comprises an upwardly projecting part of the respective arm.

17. A hook in accordance with claim 14 wherein the lower brick engagement means comprise a downwardly projecting part of the respective arm.

18. A hook in accordance with claim 14 wherein both the arms and the holding means are all formed of a single piece of wire.

19. A hook in accordance with claim 14 wherein each arm includes an obtuse angle bend between the respective upper and lower brick engagement means.

20. A hook in accordance with claim 14 wherein the lower brick engagement means comprise a downwardly oriented generally V-shaped portion of the arm.

* * * * *